US009976276B2

(12) United States Patent
Royer et al.

(10) Patent No.: US 9,976,276 B2
(45) Date of Patent: May 22, 2018

(54) ASSEMBLY OF BUFFERS, ROADWAY DEVICE AND CORRESPONDING USAGE

(71) Applicant: SAINT GOBAIN PAM, Pont-à-Mousson (FR)

(72) Inventors: Jean-Claude Royer, Lesmenils (FR); Vincent Rotharmel, Vandieres (FR)

(73) Assignee: Saint Gobain PAM, Pont-à-Mousson (FR)

( * ) Notice: Subject to any disclaimer, the term of this patent is extended or adjusted under 35 U.S.C. 154(b) by 46 days.

(21) Appl. No.: 15/026,045

(22) PCT Filed: Sep. 22, 2014

(86) PCT No.: PCT/EP2014/070150
§ 371 (c)(1),
(2) Date: Mar. 30, 2016

(87) PCT Pub. No.: WO2015/044092
PCT Pub. Date: Apr. 2, 2015

(65) Prior Publication Data

US 2016/0215474 A1 Jul. 28, 2016

(30) Foreign Application Priority Data

Sep. 30, 2013 (FR) ..... 13 59395

(51) Int. Cl.
*E02D 29/14* (2006.01)

(52) U.S. Cl.
CPC ..... *E02D 29/1463* (2013.01); *E02D 29/14* (2013.01); *E02D 29/1454* (2013.01); *E02D 29/1472* (2013.01)

(58) Field of Classification Search
CPC . E02D 29/14; E02D 29/1427; E02D 29/1454; E02D 29/1463
(Continued)

(56) References Cited

U.S. PATENT DOCUMENTS 1,719,151 A * 7/1929 Wathey ..... E02D 29/14 16/267
2,997,932 A * 8/1961 Taylor ..... E02D 29/14 404/26
(Continued)

FOREIGN PATENT DOCUMENTS

CN 1170069 A 1/1998
CN 201165667 Y 12/2008
(Continued)

OTHER PUBLICATIONS

First Office Action issued by the State Intellectual Property Office of China dated Oct. 9, 2016 in the corresponding Chinese patent application No. 201480058728.8—9 pages.
(Continued)

*Primary Examiner* — Gary S Hartmann
(74) *Attorney, Agent, or Firm* — Knobbe, Martens, Olson & Bear, LLP

(57) ABSTRACT

An assembly of covers for a roadway device has a first cover having a first linking side and a first plate-that extends along a first plane of a plate and which includes an upper surface, and second cover having a second linking side that is adjacent to the first linking side and a second plate that extends along a second plane of a plate and which includes an upper surface, wherein the assembly of the covers includes the linking part that connect the first cover to the second cover along the first and second linking sides; wherein the linking part include the hinge that define an axis of a hinging between the first cover and the second cover along the first and second linking sides. The assembly of covers is applicable to access manholes for accessing telecommunications installations or facilities.

19 Claims, 10 Drawing Sheets

(58) Field of Classification Search
USPC ..... 404/25; 137/371; 49/371
See application file for complete search history.

(56) References Cited

U.S. PATENT DOCUMENTS 3,129,278 A * 4/1964 Watt, Jr. ..... H05K 9/0015 174/366
3,221,616 A * 12/1965 Flegel ..... E03F 5/046 49/464
4,508,469 A * 4/1985 Dumortier ..... E02D 29/14 404/25
7,866,915 B2 * 1/2011 Pendleton ..... E02D 29/14 404/25
8,292,540 B2 * 10/2012 Pickavance ..... E02D 29/14 137/371
8,511,930 B2 * 8/2013 Royer ..... E02D 29/1427 137/371
8,591,138 B2 * 11/2013 Royer ..... E02D 29/14 404/25
2005/0025571 A1 * 2/2005 Nicks ..... E02D 29/1427 404/25
2011/0150570 A1 * 6/2011 Pickavance ..... E02D 29/14 404/25
2012/0020729 A1 * 1/2012 Royer ..... E02D 29/1427 404/25

FOREIGN PATENT DOCUMENTS

CN 201193329 Y 2/2009
EP 1 580 328 * 9/2005
FR 2 749 030 A1 11/1997
FR 2 937 061 A1 4/2010
FR 2 950 085 A1 3/2011
FR 2 954 368 * 6/2011

OTHER PUBLICATIONS

International Search Report dated Dec. 23, 2014 for International Application No. PCT/EP2014/070150.

* cited by examiner

ASSEMBLY OF BUFFERS, ROADWAY DEVICE AND CORRESPONDING USAGE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

FIELD OF THE INVENTION

The present invention relates to an assembly of covers for a roadway device, of the type comprising a first cover and a second cover;

the first cover comprising a first linking side and a first plate that extends along a first plane of the plate and which includes an upper surface; and the second cover comprising a second linking side that is adjacent to the first linking side and a second plate that extends along a second plane of the plate and which includes an upper surface.

BACKGROUND OF THE INVENTION

Disclosed in the state of the art are known roadway devices, such as access manholes for accessing telecommunications installations or facilities, consisting of a frame and two triangular covers.

In a first case, the covers are not connected, but are accommodated individually in the frame and must be individually placed in the open position in order to allow an operator to access the underground installations and facilities covered by the access manhole. This requires the manipulation of two covers.

In a second case, the two covers are connected to one another by linking means that are very "lax", such as two cotter pins, which leave ample clearance for play between the two covers. These linking means require two gripping wrenches and two operators in order to open or close the access manhole. Moreover, these linking means give rise to difficulties in lifting and the risk of the covers getting lodged or stuck in the frame.

There are also quadrilateral-shaped covers. In the closed configuration of the access manhole and due to the fact that these covers have four support points, they could rattle in the frame when there are vehicles travelling over the cover, which would generate noise.

SUMMARY OF THE INVENTION

The goal of the invention is to provide an assembly of covers that make possible the simple and economical handling of access manholes.

Another purpose of the invention is to provide an assembly of covers that is able to open along different directions of opening.

Another purpose of the invention is to provide an assembly of covers that generates no instability or jitter related noise during the passage of vehicles over the access manhole.

Another purpose of the invention is to provide for the economical and simple fabrication of the assembly of covers.

To this end, the object of the invention relates to an assembly of covers, as indicated here above, characterized in that the assembly of covers includes the linking means that connect the first cover to the second cover along the first and second linking sides;

in that the linking means include the hinge means that define an axis of hinging between the first cover and the second cover along the first and second linking sides; and in that the linking means include the first end stop means that are adapted so as to limit the angle of articulation (or breaking angle) of the second cover in relation to the first cover about the axis of hinging, to a first limiting angle and with this being in a direction of rotation that directs the two upper surfaces towards each other.

According to particular embodiments, the assembly according to the invention includes one or more of the following characteristic features:

- the assembly of covers includes the second end stop means that are adapted so as to limit the angle of articulation of the second cover in relation to the first cover about the axis of hinging, to a second limiting angle and with this being in a direction of rotation that directs the two upper surfaces in opposite directions away from each other;
- the hinge means include:
- two first protrusions arranged on the first cover, being positioned to face the second cover and adapted so as to resist against a relative displacement of the first cover in relation to the second cover perpendicularly to the first plane of the plate; and
- two second protrusions arranged on the second cover, being positioned to face the first cover and adapted so as to resist against a relative displacement of the second cover in relation to the first cover perpendicularly to the second plane of the plate;
- the first end stop means include an end stop element comprising two end stop surfaces that are directed towards each other, in particular a bolt or a cotter pin;
- the first end stop means are adjustable in a manner such that the first limiting angle is adjustable;
- the first end stop means include damping means, in particular shock absorbing elements made of plastic material;
- the first cover and the second cover are identical, in particular the second cover is turned 180° in relation to the first cover;
- at least one cover, and preferably the first and the second covers, is/are fabricated in one single piece, in particular out of cast-iron; and
- each cover has three, preferably exactly three, support surfaces on a frame.

The object of the invention also relates to a roadway device, in particular an access manhole for accessing telecommunications installations or facilities, of the type comprising a frame, characterized in that the roadway device includes in addition an assembly of covers as defined here above.

The object of the invention also relates to the use of a roadway device as defined here above, which includes the following successive steps:

- lifting up of the first cover in relation to the second cover in rotation about the axis of hinging while the second cover remains in place supported on the support surfaces of the frame until such point as the second cover and the first cover form the first limiting angle,
- lifting up of the first cover and the second cover, together as a single unit, relative to the frame, while the first cover and the second cover are in the configuration in which the second cover and the first cover form the first limiting angle.

BRIEF DESCRIPTION OF THE DRAWINGS

The invention will be better understood after the review of the description that follows, given only by way of an example and with reference being made to the annexed drawings, in which.

DETAILED DESCRIPTION OF THE PREFERRED EMBODIMENTS

Figure 1:
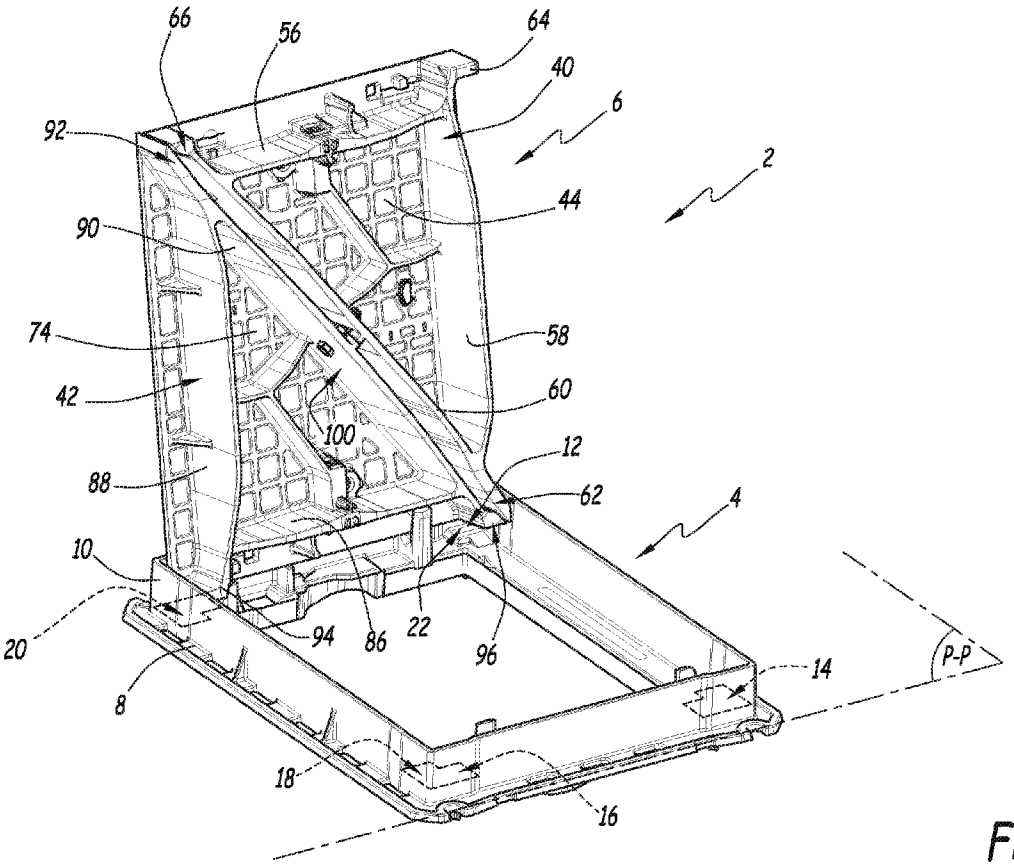
FIG. 1 is a three-quarter view from the front of a roadway device according to the invention, in its open configuration.
Figure 2:
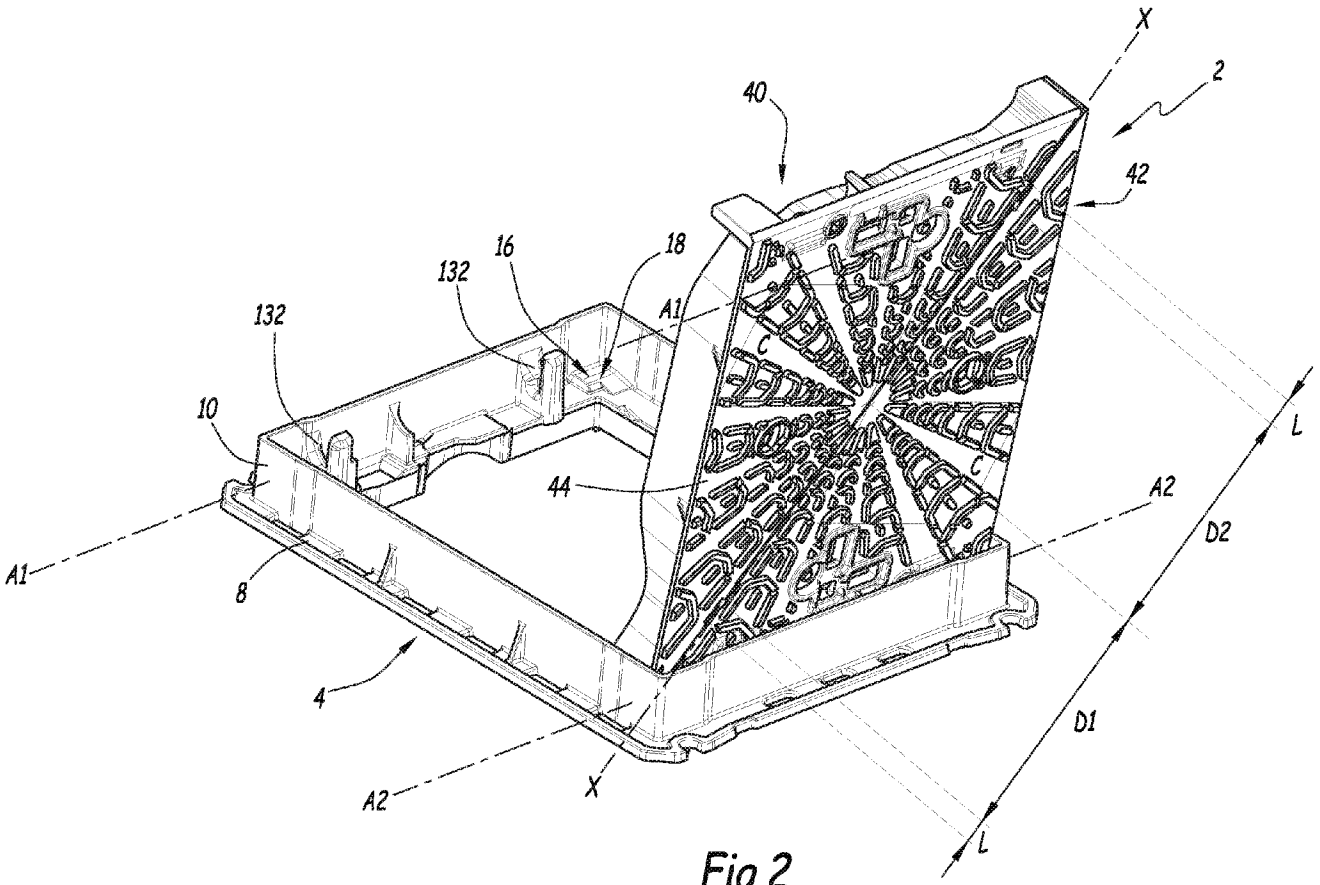
FIG. 2 is a three-quarter view from the rear-side of the roadway device shown in FIG. 1.
Figure 3:
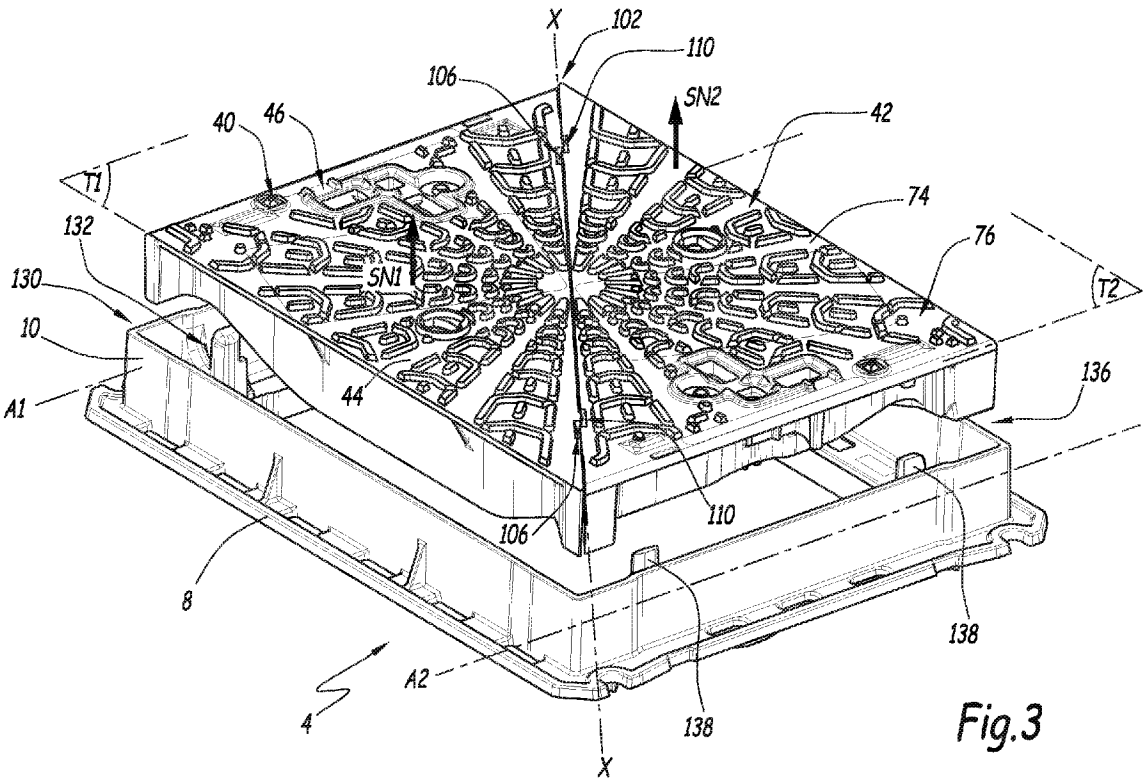
FIG. 3 is a view that is similar to the one in FIG. 1, with the assembly of covers being in a raised position in relation to the frame.
Figure 4:
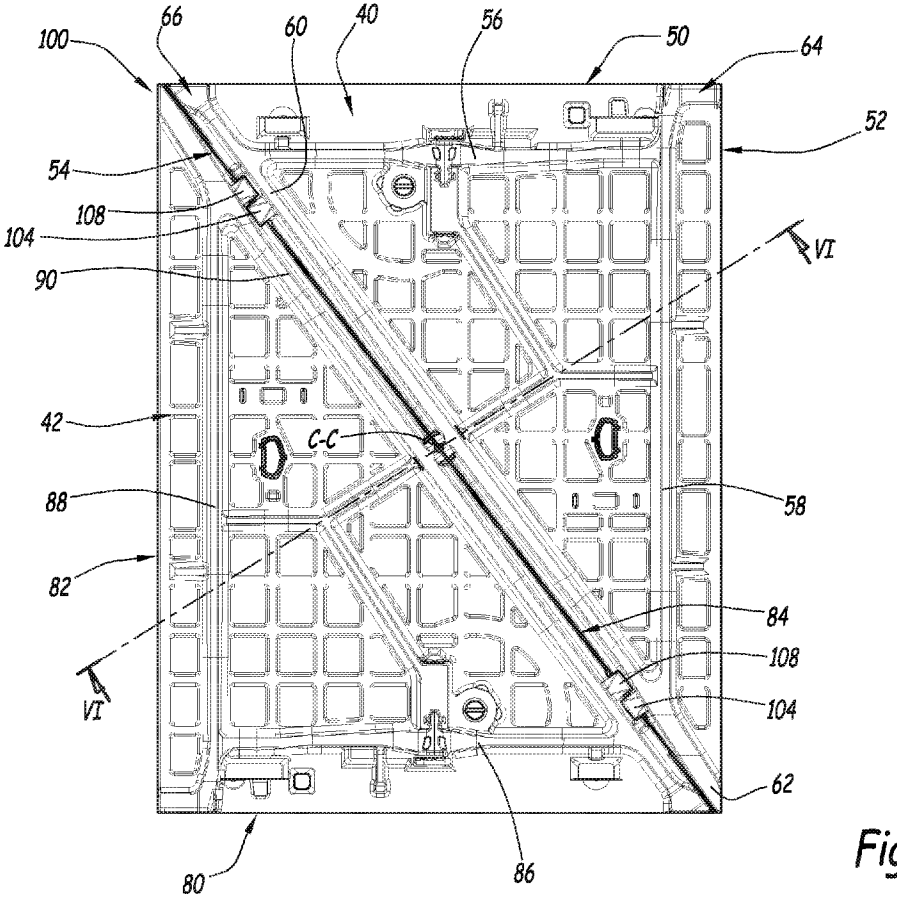
FIG. 4 is an under-side view of the cover assembly shown in FIG. 1.
Figure 5:
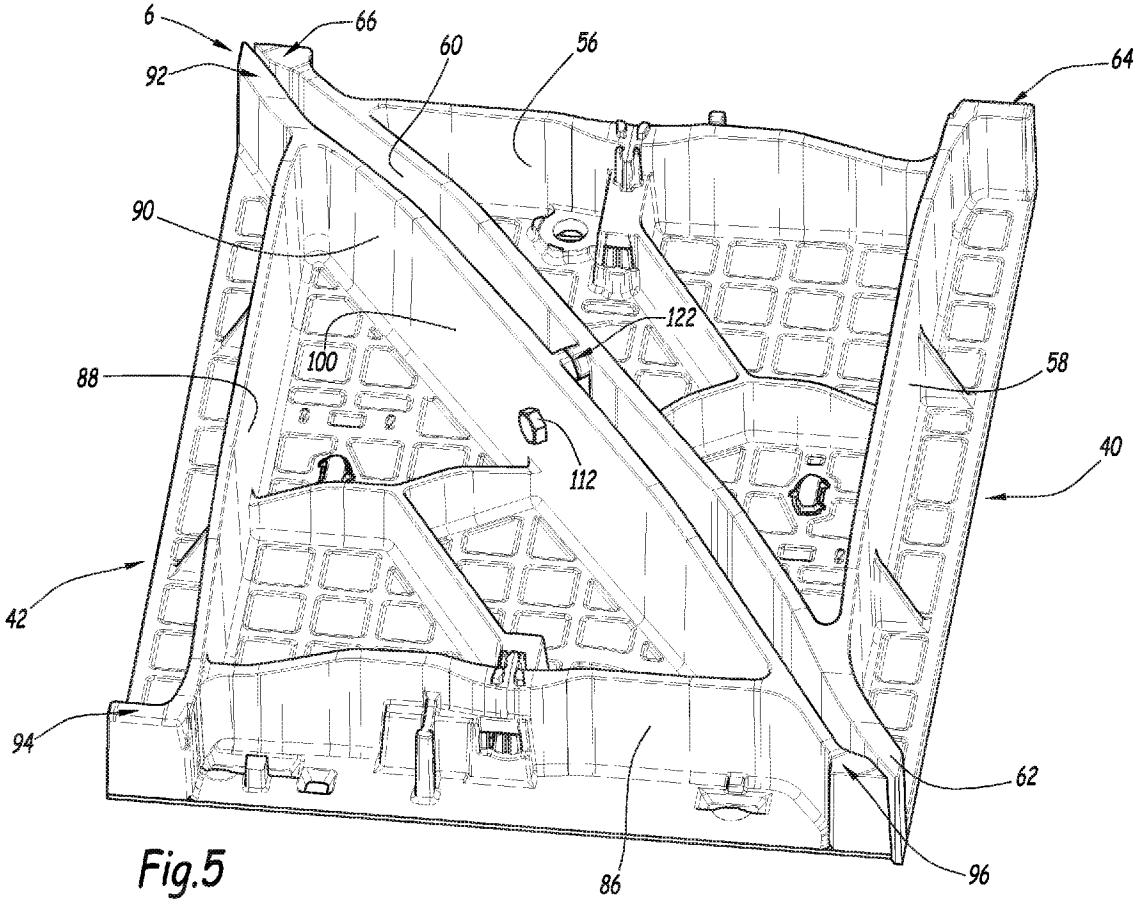
FIG. 5 is a perspective view of the under-side of the cover assembly shown in FIG. 1.

FIG. 1 shows a roadway device according to the invention, which is denoted by the general reference numeral 2. The roadway device 2 is an access manhole for accessing telecommunications installations and facilities. By way of a variant, the roadway device 2 is an access manhole for accessing other underground installations and facilities, for example an access causeway manhole for access to the water pipe lines.

The roadway device 2 comprises a frame 4 and an assembly of covers 6.

The terms "upper" and "under side" will be used subsequently in relation to the usual orientation of the roadway device 2, with the "upper" side being positioned so as to face the exterior of the installation and the "under" side being positioned so as to face the interior of the installation.

The frame 4 is fabricated integrally as one single piece, in particular out of cast-iron. By way of a variant, it may also be constituted of multiple pieces assembled in various ways, for example by means of welding.

The frame 4 includes a frame base 8, which extends along a base plane P-P, and a frame wall 10 extending perpendicularly in relation to the frame base 8. The plane of the frame P-P is generally headed parallelly to the ground in which the roadway device 2 is installed.

The frame 4 contains a first set of support surfaces 12, 14, 16 for a cover as well as a second set of support surfaces 18, 20, 22 for another cover. Each support surface 12, 14, 16, 18, 20, 22, 24 extends substantially parallelly to the plane of the frame P-P. Two support surfaces 12, 16 of the first set of support surfaces are adjacent to one of the support surfaces 18, 22 of the second set of support surfaces. The two other support surfaces 14 and 20 of the sets of support surfaces are located in opposite corners of the frame 4.

All of the support surfaces are ideally coplanar. However, on account of manufacturing tolerances and the desire to provide for maximum stability under intense road traffic conditions, through a lifting triangle that is as large as possible, they may be offset relative to one another by a determined maximum offset distance, which for example is 3 mm. The pre-determined maximum offset distance is the distance, measured perpendicularly to the plane of the frame P-P between the two support surfaces having the greatest mutual distance perpendicular to the plane of the frame P-P. This offset may also be an angular offset of the order of a few degrees at the maximum, for example 3 degrees, with the effect of stabilisation of the cover towards the geometric centre of the access manhole.

The assembly of covers 6 includes a first cover 40 and a second cover 42. The first cover 40 and the second cover 42 are fabricated as/in one single piece, in particular out of cast-iron.

The assembly of covers 6 is movable in relation to the frame 4 between a closed position, in which the assembly of covers 6 lies in the frame and the planes of the plate T1-T1 and T2-T2 are generally parallel to the plane of the frame P-P (see here below), and an open position, in which the assembly of covers 6 releases the opening of the frame 4 and is disposed outside the frame 4.

Figure 6:
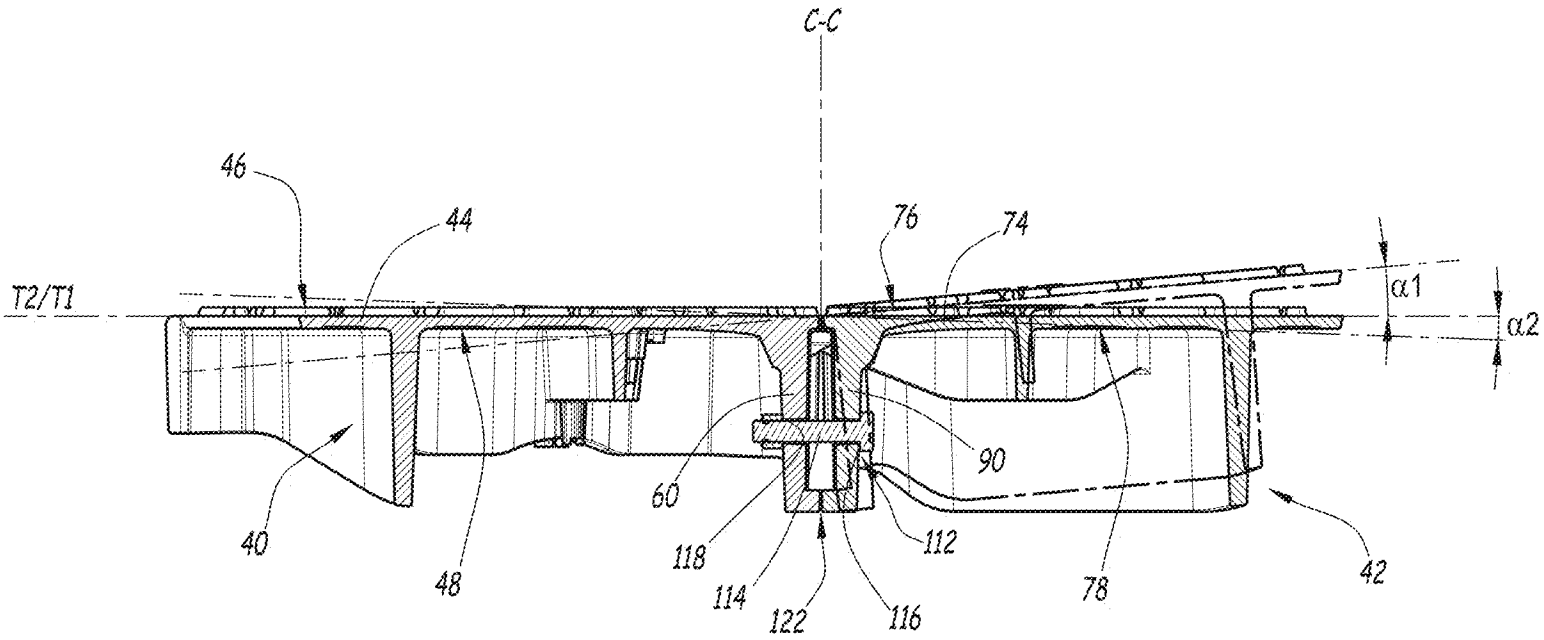
FIG. 6 is a cross sectional view along the line VI-VI shown in FIG. 4.

The first 40 and second 42 covers are identical. In the mounted state of the assembly of covers 6, the second cover 42 is turned 180° in relation to the first cover 40 around a central axis of symmetry C-C (FIG. 6).

The first cover 40 has a first plate 44 that extends along an initial plane of the plate T1-T1 (FIG. 6) and includes a top surface 48 and an under side surface 46.

The first cover 40 is of a substantially right-angled triangular shape and delimits three sides 50, 52, 54. One of the sides 54 is a first linking side, which is used to connect the first cover 40 to the second adjacent cover 42. In the case considered, the first linking side is the hypotenuse of the right-angled triangle. Each side 50, 52, 54 is formed by an edge of the first plate 44.

The first cover 40 includes three first stiffening reinforcing ribs 56, 58, 60. Each first stiffening reinforcing rib 56, 58, 60 extends along one of the sides 50, 52, 54 on the under side surface of the first plate 44. The stiffening reinforcing rib 60 that extends along the first linking side is a first linking rib.

The first cover 40 includes three first support surfaces 62, 64, 66, for supporting the cover that are adapted so as to rest on the first set of support surfaces 12, 14, 16 of the frame, when the assembly of covers 6 is in the closed position.

The three first support surfaces 62, 64, 66, of the first cover 40 are parallel to each other and parallel to the first plane of the plate T1-T1. The first three support surfaces 62, 64, 66, for supporting the cover are ideally coplanar. On account of the manufacturing tolerances or of a particular geometry of the access manhole, they may, however, be offset relative to each other. This offset distance is the distance, measured perpendicularly to the first plane of the plate T1-T1, between the first two cover support surfaces 62, 64, 66, having the greatest mutual distance perpendicular to the first plane of the plate T1-T1. They may also be offset angularly by a determined maximum angular offset, which is for example equal to 3 degrees, the angular offset corresponding to the actual angle of the first support surfaces 62, 64, 66 relative to a determined theoretical angle of construction.

The first cover 40 defines a first normal direction SN1, directed from the upper surface 46 perpendicularly to the first plane of the plate T1-T1. In the closed position, the first normal direction SN1 is therefore directed perpendicularly to the plane of the frame P-P. This first normal direction SN1 corresponds to a direction of lifting of the first cover 40 when it is being removed out of the frame from the closed position.

The second cover 42 has a second plate 74 that extends along a second plane of the plate T2-T2 (FIG. 6) and includes a top surface and an under side surface 78 76.

The second cover 42 is of a substantially right-angled triangular shape and delimits three sides 80, 82, 84. One of the sides 84 is a second linking side, which is used to connect the second cover 42 to the first adjacent cover 40. In the case considered, the second linking side is the hypotenuse of the right-angled triangle. Each side 80, 82, 84 is formed by an edge of the second plate 74.

The second cover 42 includes three second stiffening reinforcing ribs 86, 88, 90. Each second stiffening reinforcing rib stretches along one of the sides 80, 82, 84 over the under side surface of the second plate 74. The stiffening reinforcing rib 90 that extends along the second linking side is a second linking rib.

The second cover 42 also includes three second support surfaces 92, 94 96 for supporting the cover that are adapted so as to rest on the second set of support surfaces 18, 20, 22 of the frame 4, when the assembly of covers 6 is in the closed position.

The three second support surfaces 92, 94, 96 of the second cover are parallel to each other and parallel to the second plane of the plate T2-T2. The three support surfaces 92, 94, 96 are also ideally coplanar. On account of the manufacturing tolerances or of a particular geometry of the access manhole, they may, however, be offset relative to one another by a determined maximum offset distance, which for example is 3 mm. The pre-determined maximum offset distance is the distance, measured perpendicularly to the second plane of the plate T2-T2, between the two second support surfaces 92, 94, 96 of the second cover 42 having the greatest mutual distance perpendicular to the second plane of the plate T2-T2. They may also be offset angularly by a determined maximum angular offset, which is for example equal to 3 degrees, the angular offset corresponding to the actual angle of the second support surfaces 92, 94, 96 relative to a determined theoretical angle of construction.

The second cover 42 defines a second normal direction SN2, directed from the upper surface 76 perpendicularly to the second plane of the plate T2-T2. In the closed position, the second normal direction SN2 is therefore directed perpendicularly to the plane of the frame P-P. This second normal direction SN2 corresponds to a direction of lifting of the second cover 42 when it is being removed out of the frame from the closed position.

The assembly of covers 6 includes the linking means 100 that connect the first cover 40 to the second cover 42 along the first 54 and second 84 linking sides.

Figure 7:
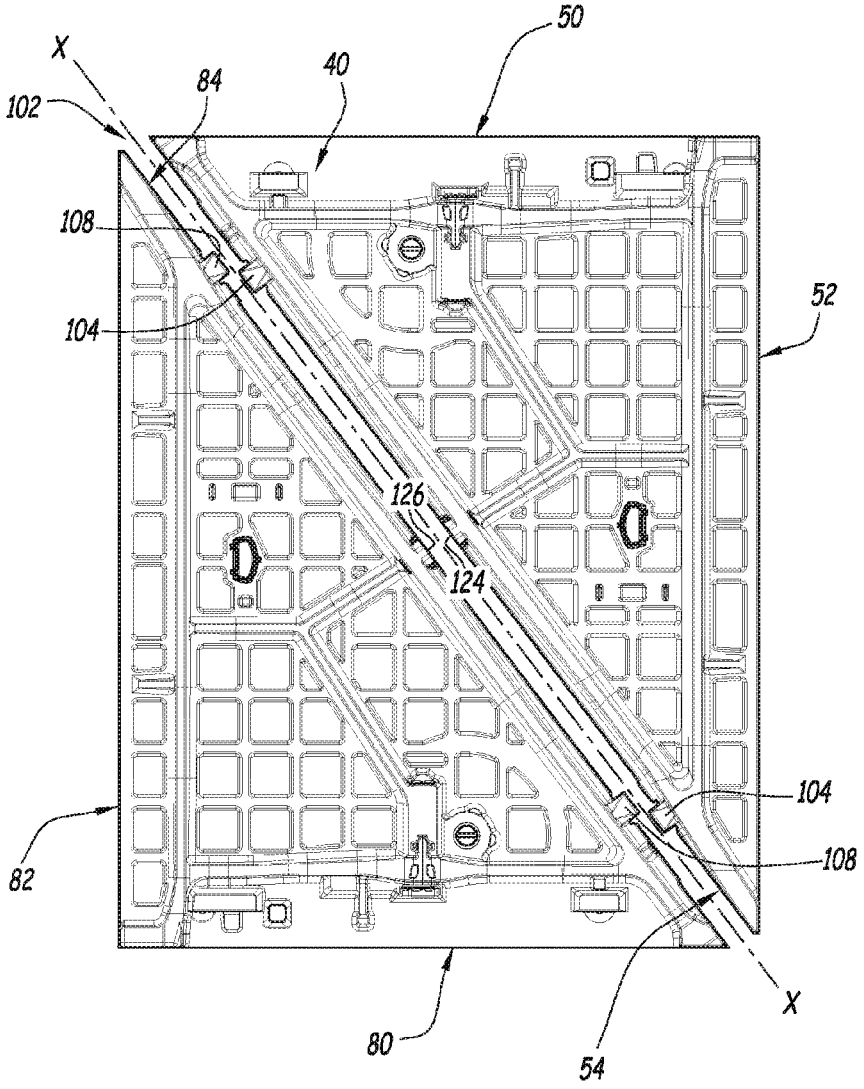
FIG. 7 is a view corresponding to the view shown in FIG. 4, of the two covers of the cover assembly, in the detached state.
Figure 8:
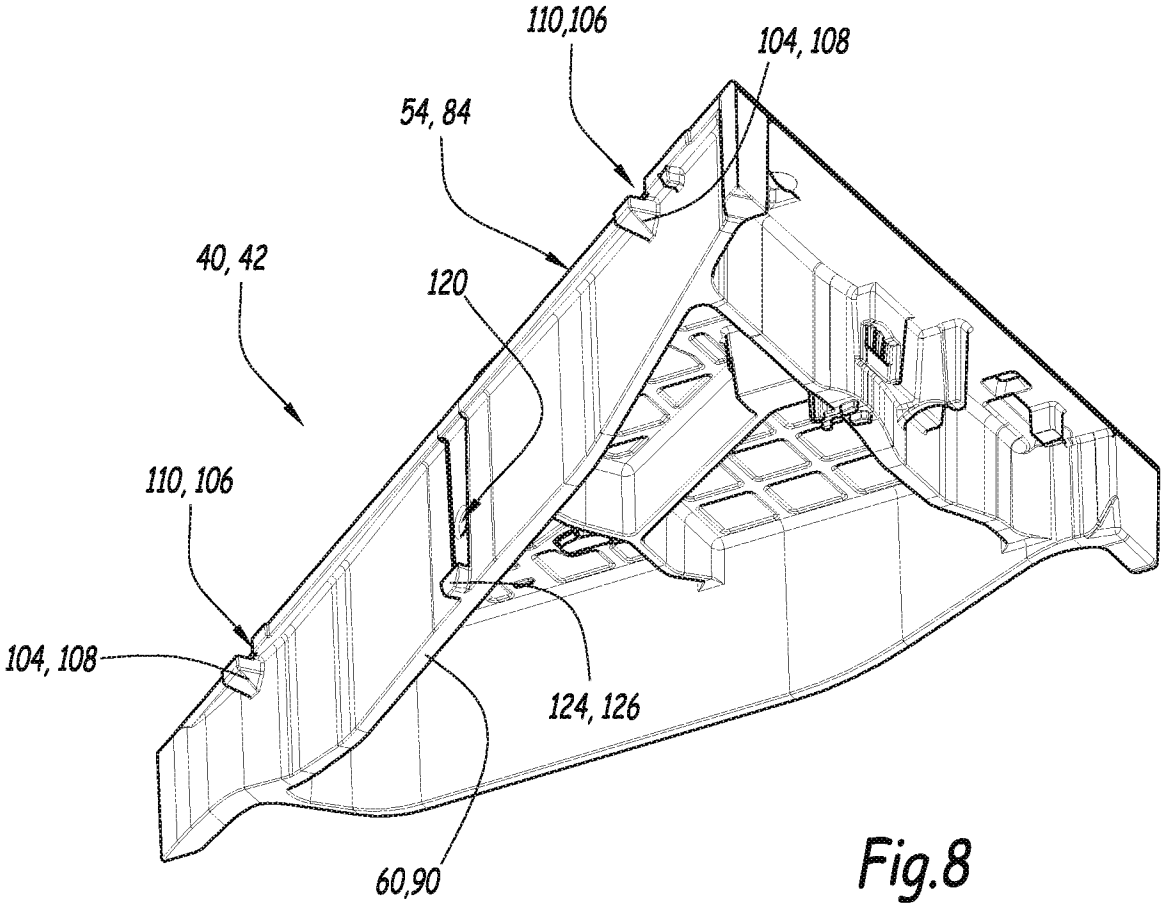
FIG. 8 is a perspective view of the under-side of a cover of the roadway device shown in FIG. 1.
Figure 9:
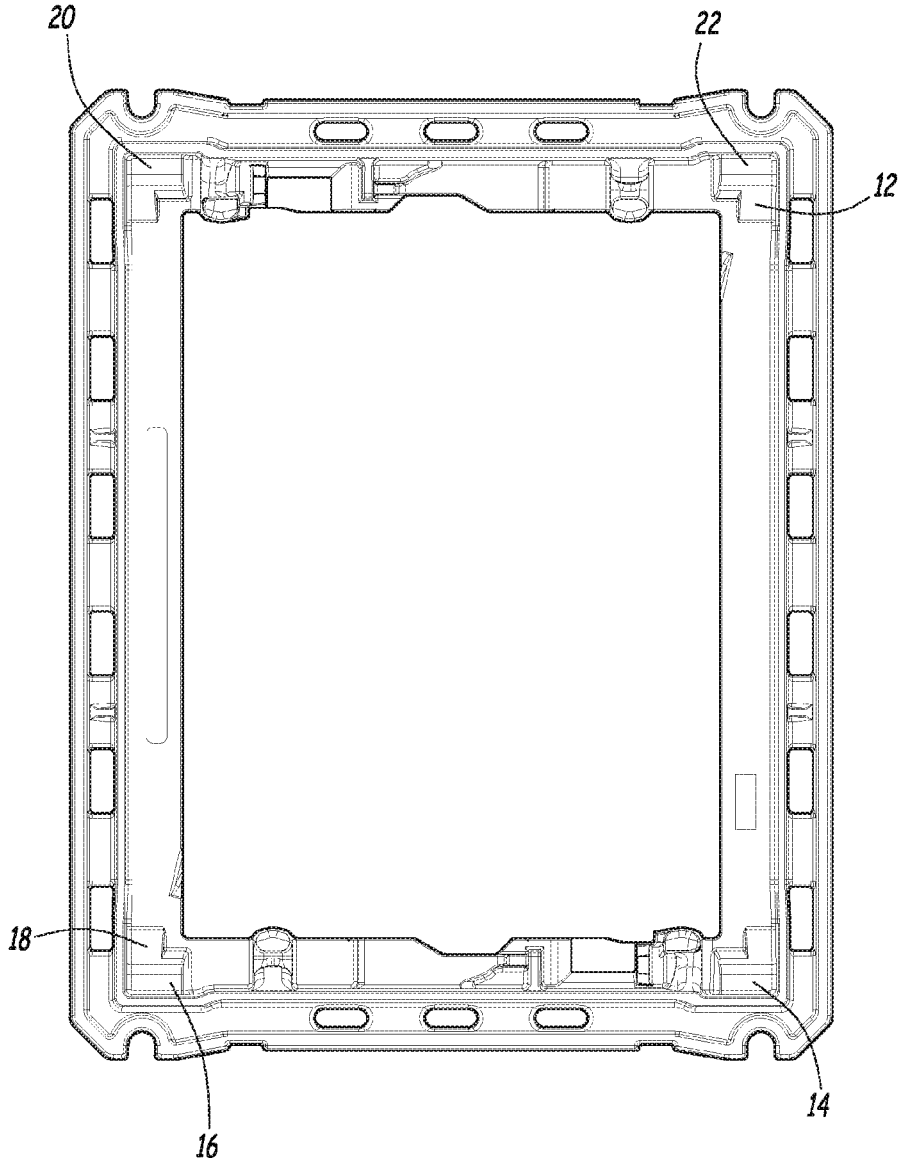
FIG. 9 is a planar top view of the frame of the roadway device shown in FIG. 1.

To this end, the linking means 100 include the hinge means 102 (FIG. 7) that define a axis of hinging X-X between the first and second covers 40, 42 with this latter being along the first 54 and second 84 linking sides. The hinge means 102 are adapted so as to guide the two covers 40, 42 each one relative to the other about the axis of hinging X-X, preferably with a determined radial clearance/allowance relative to the axis X-X.

The hinge means 102 include two first protrusions 104 arranged on the first cover 40, being positioned so as to face the second cover 42 and adapted so as to resist against a relative displacement of the first cover 40 in relation to the second cover 42 in the first normal direction SN1 radially in relation to the axis of hinging X-X.

Each first protrusion 104 is fabricated as one single piece with the first cover 40 and is preferably formed integrally with this first cover 40, for example by means of casting. By way of a variant, each first protrusion 104 is formed integrally with the first cover 40 and is joined to this cover 40, for example by means of welding. By way of yet another variant, each first protrusion 104 is formed by a member that is joined and fastened in a releasable manner to the first cover 40, such as a bolt, a cotter pin, a clip, a key or any other element that makes it possible to join together the two covers 40, 42 while also leaving the degrees of freedom necessary for the proper functioning thereof.

The first protrusions 104 are arranged on the first linking rib 60, are adjacent to the first under side surface 48 and are in particular axially aligned along the axis of hinging X-X. When the two covers 40, 42 are assembled, the first protrusions 104 are applied on the second under side surface 78.

The first protrusions 104 are arranged respectively at distances D1 and D2 from the central axis C-C, measured along the axis of hinging X-X. The distances D1 and D2 differ from each other at least in the width L of the first protrusions 104 measured along the axis of hinging X-X. The first protrusions 104 are therefore arranged in a manner such that when the cover 40 is turned 180° in relation to an initial position around the central axis of symmetry C-C, the first protrusions 104 do not overlap the first protrusions 104 in the initial position.

The first plate 44 is provided with a recess 106 at the locational position of each first protrusion 104 which fully releases each first protrusion 104 in the first normal direction SN1.

The hinge means 102 include two the second protrusions 108 arranged on the second cover 42, being positioned so as to face the first cover 40 and adapted so as to resist against a relative displacement of the second cover 42 in relation to the first cover 40 in the second normal direction SN2 radially in relation to the axis of hinging X-X. cover Each second protrusion 108 is fabricated as one single piece with the second cover 42 and is preferably formed integrally with this second cover 42, for example by means of casting. By way of a variant, each second protrusion 108 and is formed integrally with the second cover 42 and is joined to this cover 42, for example by means of welding. By way of yet another variant, each second protrusion 108 is formed by a member that is joined and fastened in a releasable manner to the second cover 42, such as a bolt, a cotter pin, a clip, a key or any other element that makes it possible to join together the two covers 40, 42 while also leaving the degrees of freedom necessary for the proper functioning thereof.

The second protrusions 108 are arranged on the second linking rib 90, are adjacent to the second under side surface 78 and are in particular axially aligned along the axis of hinging X-X. When the covers 40, 42 are assembled, the second protrusions 108 are applied on the first under side surface 48.

The second protrusions 108 are arranged respectively at distances D1 and D2 from the central axis C-C, measured along the axis of hinging X-X. The distances D1 and D2 differ from each other at least in the width L of the second protrusions 108 measured along the axis of hinging X-X. The second protrusions 108 are therefore arranged in a manner such that when the cover 42 is turned 180° in relation to an initial position around the central axis of symmetry C-C, the second protrusions 108 do not overlap the second protrusions 108 in the initial position.

The second plate 74 is provided with a recess 110 at the locational position of each second protrusion 108 which fully releases each second protrusion 108 in the second normal direction SN2.

The assembly of covers 6 defines an aligned configuration, in which the first plane of the plate T1-T1 and the second plane of the plate T2-T2 are coplanar. The assembly of covers 6 also defines an angle of articulation which is the angle of offset of the first plane of the plate T1-T1 in relation to the second plane of the plate T2-T2 about the axis of hinging X-X starting from the aligned configuration. The assembly of covers 6 includes in addition the first end stop means 112 that are adapted so as to limit the angle of articulation (FIG. 6) of the second cover 42 in relation to the first cover 40 about the axis of hinging X-X to a first limiting angle $\alpha 1$ and with this being in a direction of rotation that directs the two upper surfaces 46, 76 towards each other. The first limiting angle $\alpha 1$ is equal to or less than 5° and is comprised between 1° and 5°.

The first end stop means 112 therefore oppose a separation of the two linking ribs 60, 90 beyond a predetermined distance perpendicularly to the axis of hinging X-X. This predetermined distance for example is 3 mm.

The first and second covers 40, 42 are free in rotation about the axis of hinging X-X between the aligned configuration of the assembly of covers 6 and the configuration in which the second cover 42 forms in relation to the first cover 40 the first limiting angle.

The first end stop means 112 includes an end stop element 114 comprising two end stop surfaces 116, 118 being positioned so as to face each other. In this case, the end stop element 114 is a bolt having a screw and a nut. The two end stop surfaces 116, 118 are applied on the linking ribs 60, 90.

To this end, each linking rib 60, 90 has a through hole 120 through which the end stop element 114 passes. The through hole 120 is arranged approximately in the middle of the height extension of the linking rib 60, 90, therefore in the neutral axis. In addition, the through hole 120 is arranged in the middle of the axial length extension of the linking side 54, 84.

The end stop means 112 are adjustable, in a manner such that the first limiting angle $\alpha 1$ is adjustable. In this present case, this adjustment is obtained by moving the nut in relation to the screw.

By way of a variant, the end stop element 114 may include a cotter pin. Also by way of a variant, the first end stop means 112 include shock absorbing means, such as shock absorbing elements made of plastic material (not represented) arranged between the end stop element 114 and the linking ribs 60, 90.

The assembly of covers 6 includes the second end stop means 122 that are adapted so as to limit the angle of articulation of the second cover 42 in relation to the first cover 40 about the axis of hinging X-X to a second limiting angle $\alpha 2$, and with this being in a direction of rotation that moves the two upper surfaces 46, 76 away from each other. The second limiting angle is for example less than 3°.

The second end stop means 122 include a first nose 124 disposed on the first linking rib 60 of the first cover 40 and a second nose 126 disposed on the second linking rib 90 of the second cover 42. The first nose 124 and the second nose 126 are disposed adjacent to the free lower edge of the corresponding linking rib 60 90.

The first and second covers 40, 42 are free in rotation about the axis of hinging X-X between the aligned configuration of the assembly of covers 6 and the configuration in which the second cover 42 forms in relation to the first cover 40 the first limiting angle $\alpha 2$.

The second limiting angle $\alpha 2$ is also defined by the first end stop means 112 given that when the second limiting angle $\alpha 2$ is reached, the first end stop means 112 oppose the separation of the two linking ribs 60, 90 beyond the second limiting angle $\alpha 2$.

The roadway device 2 is in addition equipped with a first hinge 130 adapted so as to guide/drive the assembly of covers 6 about a first pivoting axis A1-A1 about the frame 4 between the closed position and the open position. The first hinge 130 includes a first frame knuckle 132 and a first cover knuckle 134.

The roadway device 2 is in addition equipped with a second hinge 136 adapted so as to guide the assembly of covers 6 about a second pivoting axis A2-A2 about the frame 4 between the closed position and the open position. The second hinge 136 includes a first frame knuckle 138 and a first cover knuckle 140.

The roadway device 2 shown in the FIGS. 1 to 9 is a variant that is not blocked. Thus, the roadway device 2 does not include any means for locking or blocking that prevent against the lifting up of the assembly of covers 6 relative to the frame 4 or against the pivoting of the assembly of covers 6 from the closed position to the open position thereof.

The roadway device works in the following manner.

The operation begins from the closed configuration.

In this configuration, the assembly of covers 6 is arranged in the frame 4 and all of the support surfaces of the two covers 40 and 42 are applied on the associated support surfaces of the frame. Depending on the eventual possible misalignments of the various supports of the covers on the frame, the angle of articulation between the two covers 40, 42 is located between 0° (aligned configuration) and the second limiting angle $\alpha 2$ or between 0° and the first limiting angle $\alpha 1$.

During the passage of a vehicle, the two covers therefore do not rattle/clatter against the frame, on account of the stability of support at three points.

In order to open the roadway device 2 by pivoting of the assembly of covers 6 about the frame, an operating-manoeuvring member is introduced into an operational opening of the first cover 40 and the first cover 40 is lifted up in relation to the frame and in relation to the second cover 42 about the axis of hinging X-X, until such point as the first cover 40 and second cover 42 are in the configuration in which the second cover 42 forms in relation to the first cover 40 the first limiting angle $\alpha 1$.

Subsequently, the lifting up of the first cover 40 in relation to the frame 4 is continued. The first cover 40 and the second cover 42 then pivot together as one single unit about the pivoting axis A2-A2 until such point as the assembly of covers 6 is in the open position (see FIG. 2).

By way of a variant, it is also possible to introduce an operating-manoeuvring member into an operational opening of the second cover 42 and to lift/raise up the second cover 42 in relation to the frame and in relation to the first cover 40 about the axis of hinging X-X, until such point as the second cover 42 and first cover 40 are in the configuration in which the first cover 40 forms in relation to the second cover 42 the first limiting angle $\alpha 1$.

Subsequently, the lifting up of the second cover 42 in relation to the frame 4 is continued. The second cover 42 and the first cover 40 then pivot together as one single unit about the pivoting axis A1-A1 until such point as the assembly of covers 6 is in the open position.

The assembly of covers 6 can therefore be opened, as one chooses, by means of articulation about either of the two opposite sides of the frame 4.

By way of a variant, the roadway device 2 may also be opened by two operators with the use of two operating-manoeuvring members. For this purpose, starting from the closed configuration, an operating-manoeuvring member is introduced into each operational opening of the first cover 40 and the second cover 42. Then the first cover 40 is lifted up along a first normal direction SN1 and the second cover 42 is lifted up along a second normal direction SN2 in a simultaneous manner. The two covers 40, 42 pivot relative to one another until such point as the first limiting angle $\alpha 1$ is reached. Then, the assembly of covers 6 may be removed together as one single unit from the frame 4 substantially perpendicularly relative to the plane of the frame P-P.

Figure 10:
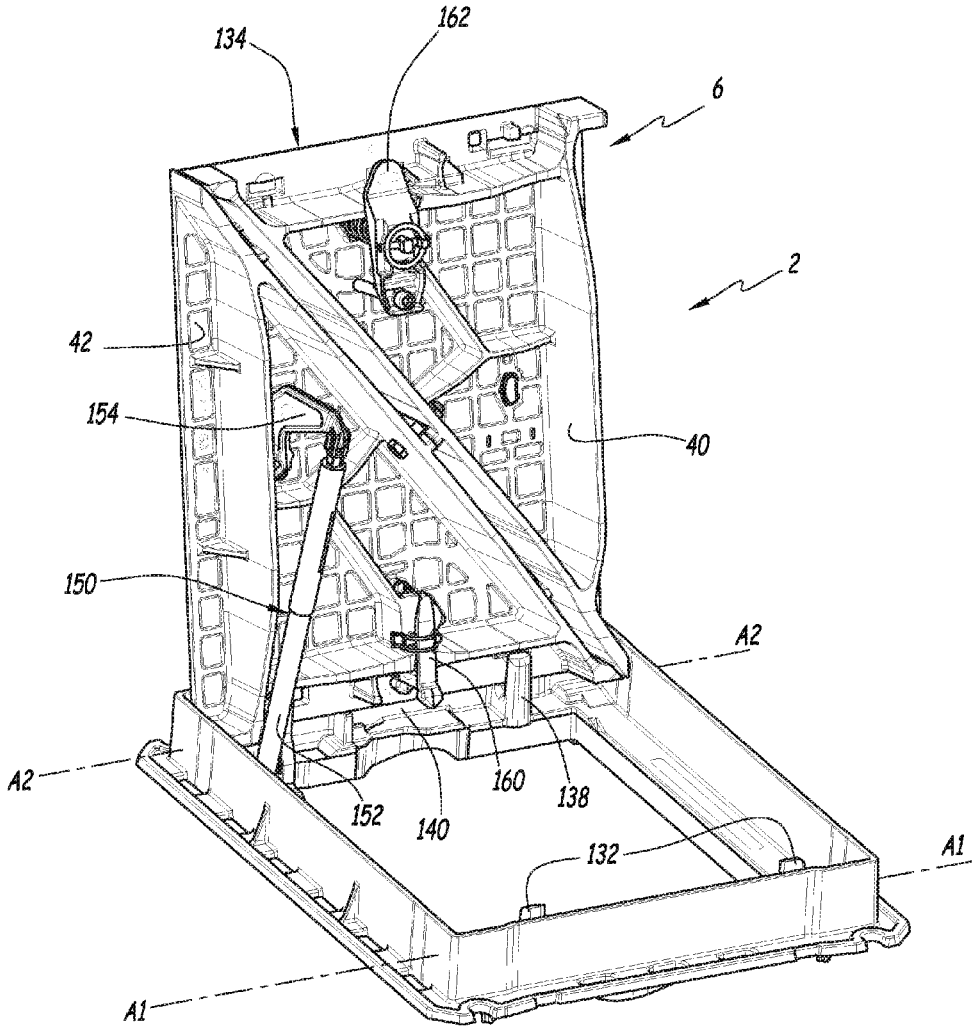
FIG. 10 is a view that is identical to the one shown in FIG. 1 of a variant of the roadway device according to the invention.

In FIG. 10 is represented a variant of the roadway device 2 according to the invention.

The roadway device 2 includes a pushing mechanism 150 adapted so as to actuate the assembly of covers 6 into the open position. The pushing mechanism 150 is equipped with a gas powered cylinder 152 and a lever 154. The lever 154 is attached on to the second cover 42. The gas cylinder 152 is articulated/hinged on the one hand to one end of the lever 154 and on the other hand to the frame 4.

The roadway device 2 also includes a locking key 160 attached to the second cover 42 and adapted so as to counter/prevent/oppose the lifting up of the assembly of covers 6, in the closed position, along a direction that is substantially perpendicular to the plane of the frame P-P.

The roadway device 2 is additionally also equipped with a rotary lock 162 that is arranged on the first cover 40 and is movable in rotation between a locking position in which the rotary lock 162 prevents the opening of the assembly of covers 6 by articulation about the frame 4, and a release position in which the assembly of covers 6 may be opened by means of pivoting relative to the frame 4.

The invention may include generally one or more of the following additional characteristic features:

The or each cover has a substantially triangular shaped form.

The cover includes a longitudinal rib extending from the under side of the cover.

The longitudinal rib has a through opening in which the first end stop is arranged.

The through opening is placed in the neutral axis line of the longitudinal rib, and preferably halfway up the height extension of this rib.

The or each cover does not have any undercuts.

The cover includes an articulation knuckle for joining to a frame.

The cover includes an articulation knuckle joint that cooperates with the articulation knuckle joint to the frame.

What is claimed is:

1. An assembly of covers for a roadway device comprising;

a first cover comprising a first linking side and a first plate that extends along a first plate plane (T1-T1), wherein the first plate comprises an first plate upper surface; and a second cover comprising a second linking side that is adjacent to the first linking side and a second plate that extends along a second plate plane (T2-T2), wherein the second plate comprises an second plate upper surface;

wherein the assembly of the covers comprises a linker that connects the first cover to the second cover along the first and second linking sides;

wherein the linker comprises a hinge that defines an axis of a hinging (X-X) between the first cover and the second cover along the first and second linking sides; and wherein the linker comprises a first end stopper that is adapted so as to limit an angle of an articulation of the second cover in relation to the first cover about the axis of the hinging (X-X) to a first limiting angle such that the second cover rotates about the axis of the hinging (X-X) in relation to the first cover and the rotation of the second cover directs said two upper surfaces towards each other, wherein the first end stopper is configured to be adjustable in a manner such that the first limiting angle is adjustable.

2. The assembly of covers according to claim 1, further comprising a second end stopper that is adapted so as to limit the angle of the articulation of the second cover in relation to the first cover about the axis of the hinging (X-X) to a second limiting angle and such that the second cover rotates about the axis of the hinging (X-X) in relation to the first cover and the rotation of the second cover directs said two upper surfaces in opposite directions away from each other.

3. The assembly of covers according to claim 1, wherein the hinge comprises:

two first protrusions arranged on the first cover, being positioned to face the second cover and adapted so as to resist against a relative displacement of the first cover in relation to the second cover perpendicularly to the first plate plane (T1-T1); and two second protrusions arranged on the second cover, being positioned to face the first cover and adapted so as to resist against a relative displacement of the second cover in relation to the first cover perpendicularly to the second plate plane (T2- T2).

4. The assembly of covers according to claim 1, wherein the first end stopper comprises an end stop element comprising two end stop surfaces that are directed towards each other.

5. The assembly of covers according to claim 1, wherein the first end stopper comprises a damper.

6. The assembly of covers according to claim 1, wherein the first cover and the second cover are identical.

7. The assembly of covers according to claim 1, wherein at least one of the covers comprising the first and the second cover is/are fabricated in one single piece.

8. The assembly of covers according to claim 1, wherein each of the covers has three support surfaces on a frame.

9. The assembly of covers according to claim 6, wherein the second cover has a configuration of 180° in relation to the first cover.

10. The assembly of covers according to claim 7, wherein the first and second covers are fabricated in one single piece made of a cast-iron.

11. A roadway device for accessing telecommunications installations or facilities, comprising;

a frame, and the assembly of the covers according to claim 1.

12. A method of accessing the telecommunications installations or facilities via the roadway device according to claim 11 comprising:

lifting up the first cover in relation to the second cover in a direction of the rotation about the axis of the hinging (X-X) while the second cover remains in place supported on support surfaces of the frame until the second cover and the first cover form the first limiting angle; and lifting up the first cover and the second cover together as a single unit relative to the frame while the first cover and the second cover are in a configuration in which the second cover and the first cover form the first limiting angle, thereby providing access to the telecommunications installations or facilities.

13. The assembly of covers according to claim 4, wherein the end stop element is a bolt or a cotter pin.

14. The assembly of covers according to claim 5, wherein the damper is a shock absorbing element made of a plastic material.

15. The roadway device according to claim 11, wherein the roadway device is an access manhole for accessing the telecommunications installations or facilities.

16. The assembly of covers according to claim 8, wherein each of the covers has exactly three support surfaces on the frame.

17. An assembly of covers for a roadway device comprising;

a first cover comprising a first linking side and a first plate that extends along a first plate plane (T1-T1), wherein the first plate comprises an first plate upper surface; and a second cover comprising a second linking side that is adjacent to the first linking side and a second plate that extends along a second plate plane (T2-T2), wherein the second plate comprises an second plate upper surface;

wherein the assembly of the covers comprises a linker that connects the first cover to the second cover along the first and second linking sides;

wherein the linker comprises a hinge that defines an axis of a hinging (X-X) between the first cover and the second cover along the first and second linking sides, wherein the linker comprises a first end stopper that is adapted so as to limit an angle of an articulation of the second cover in relation to the first cover about the axis of the hinging (X-X) to a first limiting angle such that the second cover rotates about the axis of the hinging (X-X) in relation to the first cover and the rotation of the second cover directs said two upper surfaces towards each other, and wherein the first limiting angle is equal or less than 5°.

18. The assembly of covers according to claim 17, further comprising a second end stopper that is adapted so as to limit the angle of the articulation of the second cover in relation to the first cover about the axis of the hinging (X-X) to a second limiting angle and such that the second cover rotates about the axis of the hinging (X-X) in relation to the first cover and the rotation of the second cover directs said two upper surfaces in opposite directions away from each other.

19. The assembly of covers according to claim 18, wherein the second limiting angle is less than 3°.

* * * * *